US011043149B1

(12) United States Patent
Archuletta

(10) Patent No.: US 11,043,149 B1
(45) Date of Patent: Jun. 22, 2021

(54) READILY REVERSIBLE HIGHWAY SIGN

(71) Applicant: Phil T. Archuletta, Mountainair, NM (US)

(72) Inventor: Phil T. Archuletta, Mountainair, NM (US)

( * ) Notice: Subject to any disclaimer, the term of this patent is extended or adjusted under 35 U.S.C. 154(b) by 0 days.

(21) Appl. No.: 16/903,072

(22) Filed: Jun. 16, 2020

Related U.S. Application Data

(60) Provisional application No. 62/975,669, filed on Feb. 12, 2020.

(51) Int. Cl.
*G09F 11/02* (2006.01)
*G09F 15/00* (2006.01)

(52) U.S. Cl.
CPC ..... *G09F 11/02* (2013.01); *G09F 15/0037* (2013.01); *G09F 15/0087* (2013.01)

(58) Field of Classification Search
CPC ..... G09F 7/22; G09F 11/02; G09F 15/0087
See application file for complete search history.

(56) References Cited

U.S. PATENT DOCUMENTS 266,118 A * 10/1882 Elsey ..... B43L 1/00 434/408
413,679 A * 10/1889 Obergh ..... A47B 41/02 434/419
437,016 A * 9/1890 Byrnes ..... A63J 5/02 472/81
3,496,665 A 2/1970 Goldman
3,621,807 A * 11/1971 Kang ..... E04H 6/426 116/28 A
3,965,599 A 6/1976 Ebner
4,002,022 A 1/1977 Lopez
4,015,349 A 4/1977 Dunne
4,021,946 A 5/1977 Bradshaw
4,040,194 A 8/1977 Penton et al.
4,254,569 A * 3/1981 Janik ..... G09F 15/0087 40/606.15
4,333,253 A 6/1982 Cooper
4,503,631 A 3/1985 Kelly
4,528,763 A 7/1985 Ahlgren
5,233,772 A 8/1993 Bergeron et al.
6,354,028 B1 3/2002 Gross et al.
6,378,232 B1 * 4/2002 Creech ..... G09F 7/02 248/474
6,484,428 B1 11/2002 Greenwald et al.
(Continued)

FOREIGN PATENT DOCUMENTS

FR 2622332 A1 * 4/1989 ..... G09F 15/0087

*Primary Examiner* — Cassandra Davis
(74) *Attorney, Agent, or Firm* — Rod D. Baker

(57) ABSTRACT

A reversible sign, such as a highway sign, by which either of at least two informational messages may selectively be displayed. The sign is easily reversed, so that one of the two messages is visible to oncoming viewers. The sign includes an outer frame portion in which a planar central, inner, message portion or panel is rotatably disposed. The sign is temporarily held in position to display the desired message, until the message is deliberately but easily changed by rotating the message panel. Axle assemblies are provided for rotatably mounting the message panel within the outer frame. Magnetic fasteners reliably but releasably hold the inner message panel in a desired display position in relation to the outer frame.

20 Claims, 7 Drawing Sheets

(56) References Cited

U.S. PATENT DOCUMENTS

| | | | | |
|---|---|---|---|---|
| 6,688,027 | B2 | 2/2004 | Fink | |
| 7,961,069 | B2 | 6/2011 | Fullerton et al. | |
| 8,943,723 | B2 | 2/2015 | Valentine et al. | |
| 2001/0004486 | A1 | 6/2001 | Pynenburg et al. | |
| 2003/0154638 | A1 | 8/2003 | Kern et al. | |
| 2012/0096750 | A1 | 4/2012 | Wiemer et al. | |
| 2012/0280194 | A1* | 11/2012 | Stanojevic ..... | A47C 7/56<br>256/26 |
| 2013/0036639 | A1 | 2/2013 | Bowman | |
| 2019/0333423 | A1 | 10/2019 | Kehoe et al. | |
| 2019/0378443 | A1 | 12/2019 | Wriedt | |

* cited by examiner

READILY REVERSIBLE HIGHWAY SIGN

BACKGROUND OF THE INVENTION

Field of the Invention

The present invention relates generally to signs and signage, particularly signs for use on highways and roadsides, and specifically to a reversible road sign that is easily reversible to selectively present either of two different messages.

Background of the Invention

It is, on occasion and under certain circumstances, desirable to have a sign that can be selectively changed to show either of two informational messages. For example, it may be desirable to have a sign over or adjacent a highway that indicates whether some facility is either "open" or "closed." For instance, it may be needed to indicate to approaching drivers whether a roadside weigh station, rest stop, or the like, is open or closed. It is preferable that the sign be located to provide approaching drivers adequate notice whether the roadside facility, or special lane (e.g., toll booth lane, etc.), is available for use. It also is highly preferable that such a sign be easy to change without the need for operating personnel to use ladders and/or special or heavy tools. Such a sign must also be durable, weather-resistant, and highly visible.

It is known to provide signs whose messages can be changed by pivoting a flap element between two different positions. Information is printed on the hinged, pivotal element, and on adjacent portions or substrates of the sign, so that by swinging the flap through 180 degrees between either of two positions, either of two messages can be prevented to view. Such a type of changeable sign is typified, for example, by the disclosures of U.S. Pat. No. 4,999,938 to Behling, U.S. Pat. No. 4,246,715 to Nelson, U.S. Pat. No. 4,094,083 to Fund, and U.S. Pat. No. 3,616,557 to Vara, Sr. Other known mechanically changeable road and vehicle signs are seen in U.S. Pat. No. 4,318,238 to Macarle, Jr., U.S. Pat. No. 3,518,782 to Long, and U.S. Pat. No. 3,481,060 to Hartz. These hinged and pivotal flap types of signs require the manual manipulation of various types of mechanical latches, clips, hasps, etc., to secure and disengage the movable portion. Some of these known types of signs are suitable for outdoor use near highways; others are not. When used as road signs, they may present problems. Because most highway signs are mounted high above the ground, such mechanical latches and catches require a worker disadvantageously to ascend a ladder to manipulate such fasteners to change the message display of the sign. Doing so while using tools is even less desirable. Alternatively, workers may attempt to disengage/engage the sign fasteners from ground level, using various straps, winches, poles, or tubes, which is time consuming, cumbersome, and sometimes results in damage to the sign.

It also is known to provide electronic signs whose messages are presented using arrays or matrices of individual light bulbs or LEDs. Each light source can be selectively turned on or off, so that the programmed array of illuminated light sources viewed collectively presents a message for viewing. The message can be changed by changing which individual light sources are turned "on," and which ones remain "off" Such selectively changeable electronic roadside signs, which offer certain advantages, nevertheless are expensive to acquire and maintain, demand an electrical power source for operation, and are vulnerable to damage by weather and vandals.

It is desired to provide a simple, durable, and economical, road sign that can be easily changed by a worker, at ground level and without having to manipulate latches or mechanical clips or locks, to present at least two different informational messages. The disclosed apparatus supplies this unmet need.

SUMMARY OF THE INVENTION

There is disclosed an easily reversible sign, such as a highway sign, by which either of at least two informational messages may selectively be displayed. The sign is easily reversed, so that one of the two messages is visible to oncoming drivers. However, the sign is temporarily locked in position to display the desired message, until the message is deliberately but easily changed by rotatably "flipping" a message panel of the sign.

The sign has a generally planar, two-sided, outer frame in which a planar central, inner, message portion or panel is rotatably disposed. The outer frame is supported above, or more typically, next to, a roadway or highway by supporting means, such as at least one but preferably at least two conventional signposts.

Axle assemblies are provided for rotatably mounting the message panel within the outer frame portion. In use to present a message, the inner message panel is situated coplanar with its surrounding frame. One side of the message panel is viewable at a time, while the other side is unseen on the back side of the sign. The axles permit the inner message panel to be controllably rotated between a first message position and a second message position, and visa-versa. Magnetic fasteners are strategically located on both sides of the outer frame portion, and on both sides of the inner message panel. By bringing a pair of magnets, i.e. a magnet on the inner message panel and an associated magnet on the outer frame into close adjacency, the magnets mutually attract to reliably but releasably hold the inner message panel in a desired display condition in relation to the outer frame portion.

BRIEF DESCRIPTION OF THE DRAWINGS

The attached drawings, which form part of this disclosure, are as follows.

Like elements in the several drawings are labeled with the same label numerals. The drawings are not necessarily to scale, either within a singe view or between views.

DETAILED DESCRIPTION OF THE INVENTION

Figure 1:
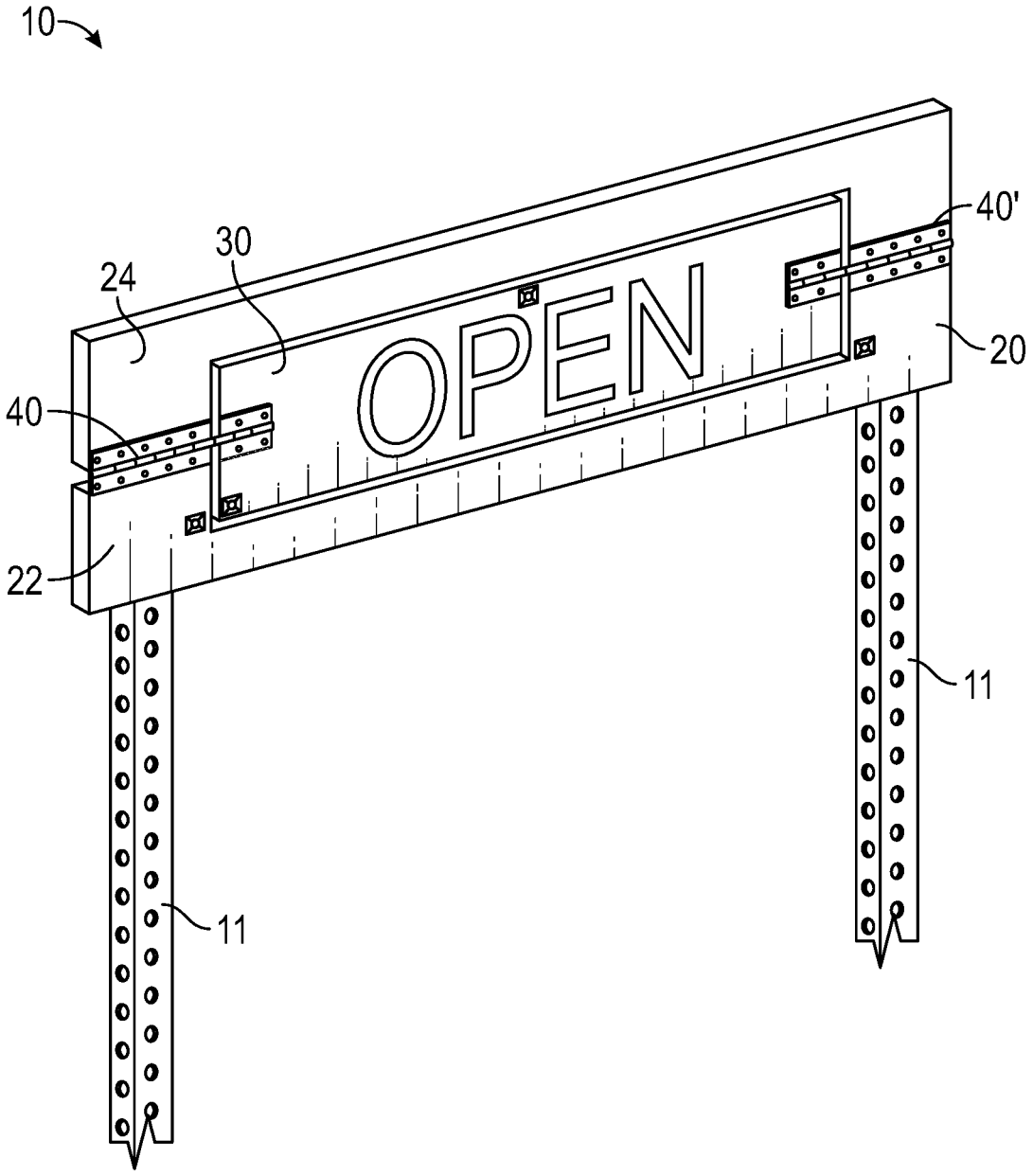
FIG. 1 is a perspective overall view of a reversible sign apparatus according to the present disclosure, with the apparatus displaying a first message on an inner message panel.
Figure 7:
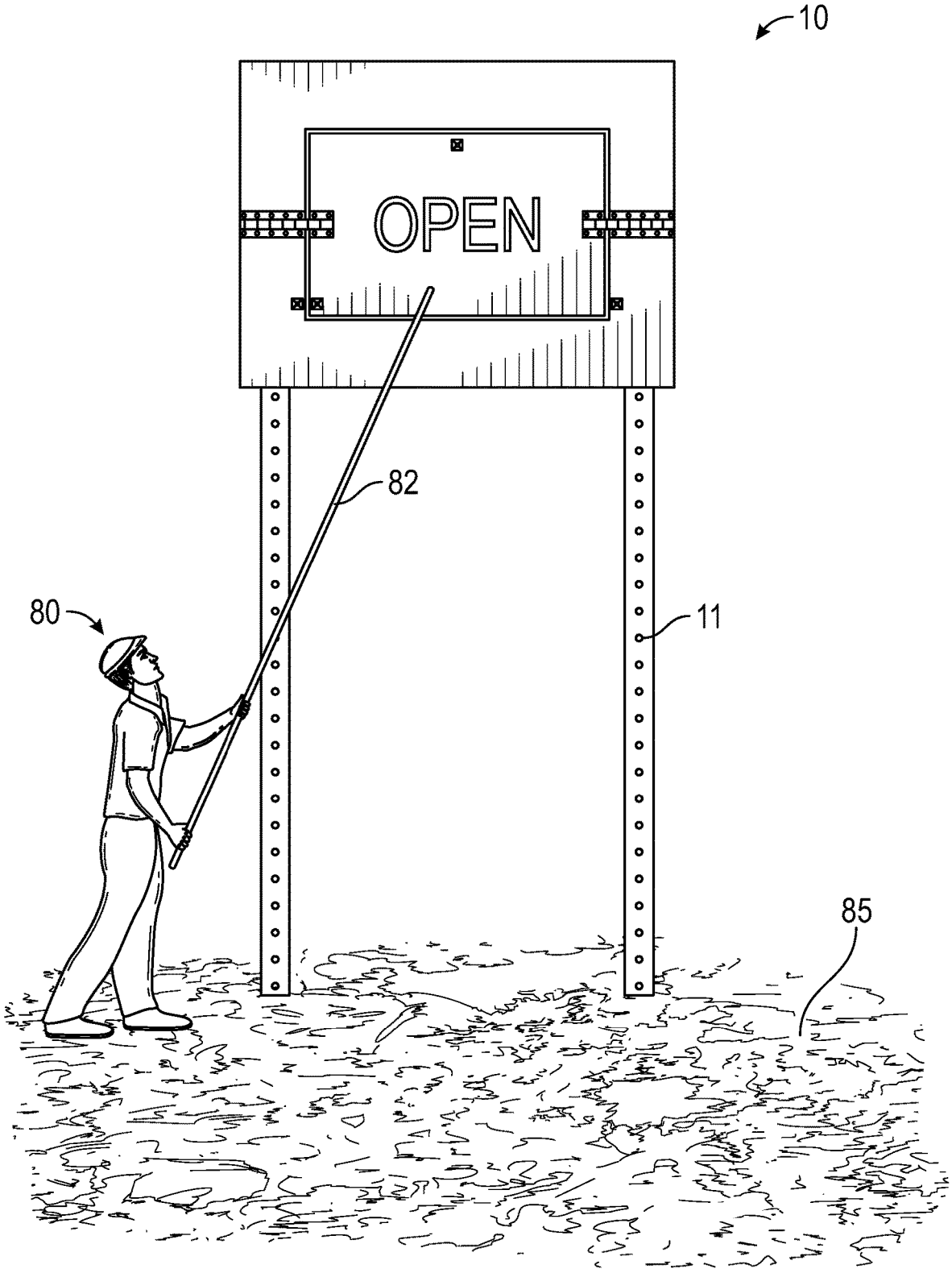
FIG. 7 is a view of a user about to operate the apparatus by rotating the inner message panel.

Combined reference to FIGS. 1 and 7 shows a preferred embodiment of a sign apparatus 10 according to the present disclosure. The sign apparatus 10 is intended particularly for use next to or above a highway, expressway, or roadway, but its useful application is not so limited. The reversible sign apparatus 10 ordinarily but not necessarily is mounted above the ground in the ordinary manner by one, or preferably at least two, signposts 11 firmly secured to/in the ground. The signposts 11 may be square slotted or perforated metal alloy box channel, as suggested in FIG. 1. Such roadside signs often are mounted from seven to ten feet, or more, above the ground. In certain other circumstances, the sign apparatus 10 may be suspended above the lane(s) of a highway or walkway from an overhead support or bridge, or the like, as known in the art.

The sign apparatus 10 is mounted to the posts 11 or other support by bolts or other secure fasteners that are connected to the outer frame portion 20 of the apparatus. As seen in FIG. 1, the sign apparatus 10 often, but not necessarily, is in the overall shape of a square or rectangle; a rectangular sign usually is oriented and mounted with its long axis generally parallel to the ground's surface below. Nevertheless, it is readily understood by one skilled in the art that the overall peripheral shape, size, and orientation in space, of the apparatus 10 can be selected from wide varieties. Advantageously for the sake of affordable operation, use in remote areas, and for durability and ease of fabrication, the sign apparatus 10 requires no source or input of electrical power.

Further attention is invited to FIG. 1. The reversible sign apparatus has the outer frame 20 and an inner message panel 30. The outer frame 20 and the inner message panel 30 each preferably are generally planar, each having parallel front and back sides or surfaces. The frame 20 and message panel 30 may be fabricated from any suitable rigid, weather-resistant, stiff material common to the art of highway signage, such as aluminum alloy, composites, wood-plastic composites, or the like, known in the art or hereafter devised. By way of example only, the frame 20 may have outside dimensions of about 60 cm height and about 183 cm width. The rotatable inner message panel 30 may have outside dimensions of about 61 cm height and about 132 cm width.

The frame 20 and message panel 30 during effective use normally are oriented generally vertically. When the message panel 30 is in proper position to present an information message for viewing by a person in front of the sign 10, the message panel is approximately co-planar with the outer frame 20. The outer frame 20 has a centrally located opening defined there-through, in which the inner message panel 30 is rotatably mounted. The inner peripheral edge of the opening in the outer frame 20 has a shape generally the same as, but a size and dimensions slightly larger than, the outer periphery of the inner message panel 30. A very modest separation gap (e.g., between 1.0 cm and about 3.0 cm, preferably about 1.5 cm) is defined between the outer edges of the inner message panel 30 and the inner edges of the outer frame 20 (that define the opening in the frame). Thus, in proper co-registration for use, the message panel 30 and frame 20 present a nearly singular planar front surface for the sign apparatus 10, as suggested by FIG. 1.

Continued reference is made to FIG. 1. Preferably but not strictly necessarily, the outer frame 20 is composed of two separate frame panels 22, 24. Typically, the lower frame panel 22 is approximately the same shape, and has about the same dimensions, as upper frame panel 24, but this is not a necessity. The two outer frame panels 22, 24 are securely and fixedly mounted on the posts 11 so to be oriented in a generally co-planar, ordinarily vertical, relationship. The frame panels 22, 24 are separated by a very modest (e.g., typically less than 2.0 cm, preferably less than 1.0 cm) horizontal frame panel gap, as seen also in FIG. 6. The use of two frame panels 22, 24 spaced apart by the frame panel gap is preferred to permit the use of rotation axles 40, 40' whose axel dowels or pins are situated within the panel gap, so to promote a flush and coplanar positional relationship between the outer frame 20 and the message panel 30 when the message panel is in in position for viewing. The frame panels 22, 24 are held in spaced relation, and maintained in proper position in space, by means of a pair of frame portion straps 70 (seen in FIGS. 3 and 5), as well as by the frame panels' secure connection to the signposts 11.

The outer frame 20 has a first or front surface, and a second or rear surface. However, the frame's position is fixed in space, so that the its front surface always faces "forward," i.e., exposed to the view of an oncoming viewer. The rear surface is viewable but seldom intentionally seen. The inner message panel 30 also has a first side and a second side. In contrast with the frame 20, either of the message panel's two sides can be positioned to face forward, toward an intended viewer, depending upon which side of the message panel 30 has been deliberately rotated into registration with the front side of the outer frame 20.

FIG. 1 illustrates that the inner message panel 30 is rotatably suspended within the outer frame 20 by a pair of colinearly aligned rotation axle assemblies 40, 40' provided at opposite lateral ends of the message panel, as will be further described herein. The axle assemblies 40, 40' define, in FIG. 1, an imaginary horizontal axis of rotation for the inner message panel 30. In an alternative embodiment, the axles 40, 40' could be situated at respective aligned top and bottom positions on the frame 20 and inner message panel 30, such that the message panel is rotatable about a vertical axis. The axle assemblies 40, 40' are preferably so located on the frame 20 and the message panel 30 such that the message panel's axis of rotation is colinear with its horizontal axis of symmetry; the message panel accordingly rotates in a smooth and balanced manner around the axis defined by the axles 40, 40'.

Figure 2:
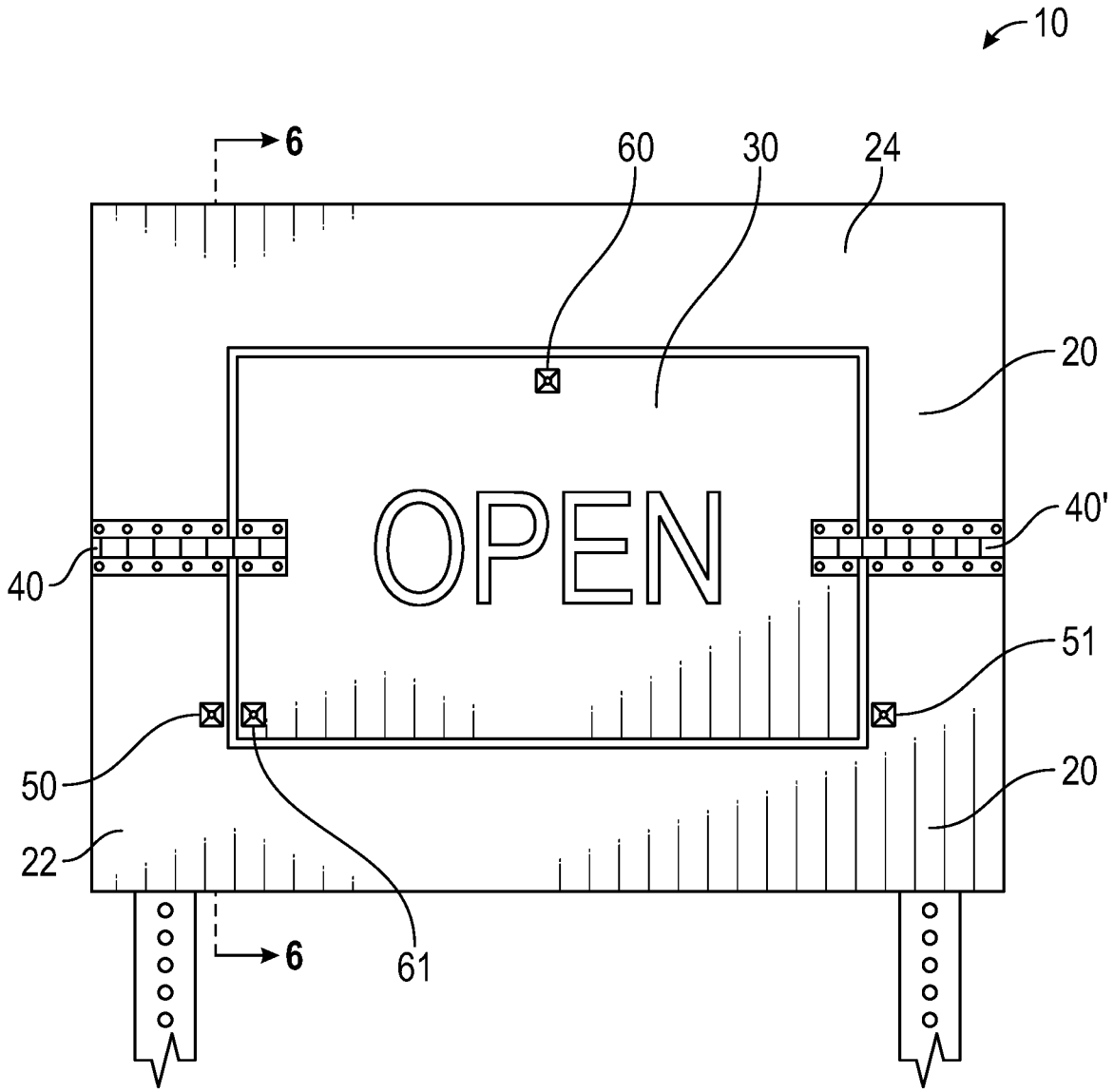
FIG. 2 is an enlarged front view of the apparatus shown in FIG. 1, seen in a first informational position, presenting a first message for viewing.
Figure 3:
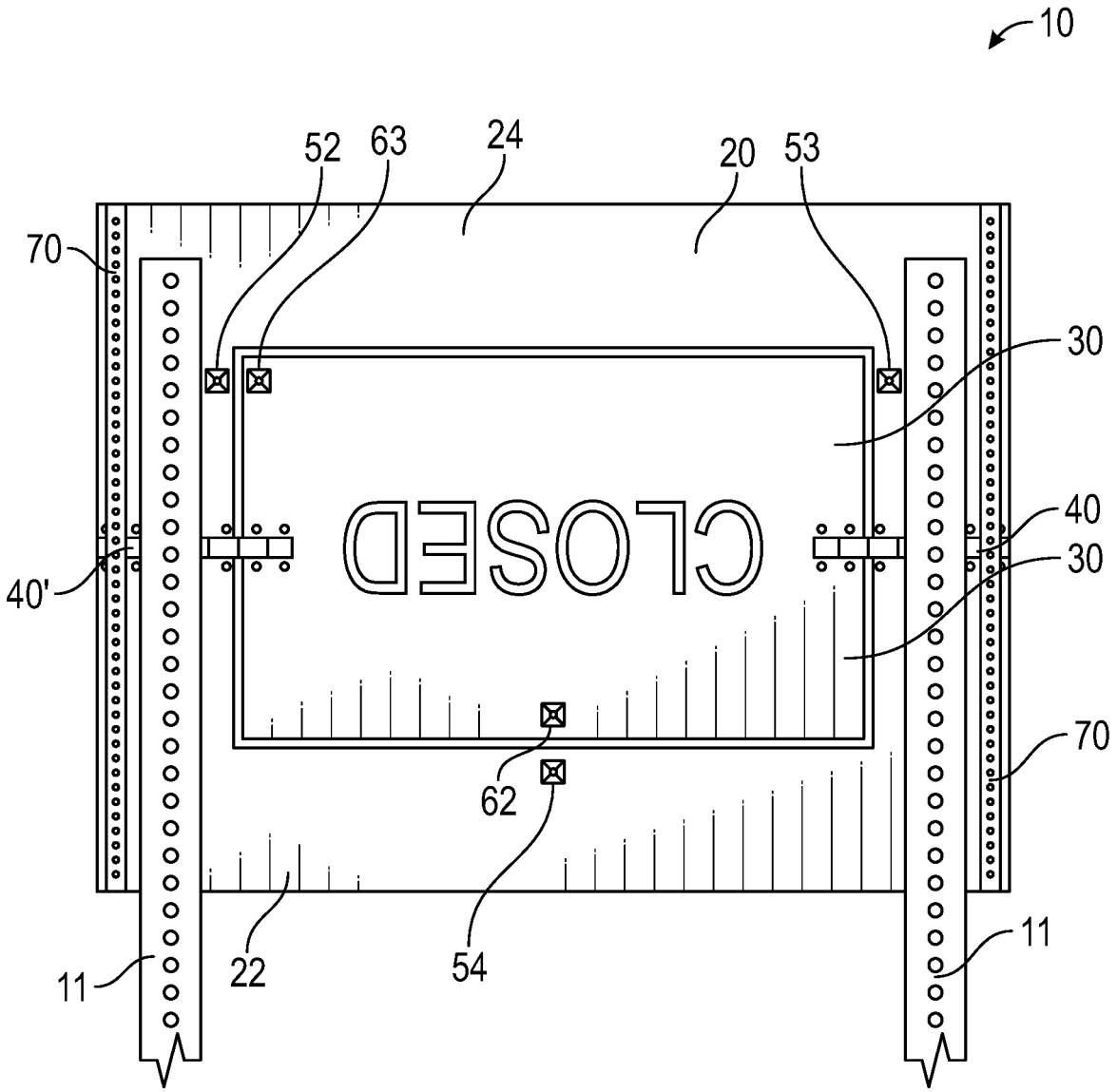
FIG. 3 is an enlarged rear view of the apparatus shown in FIG. 2, depicting a second informational message that is not presented for immediate viewing.

Reference is made to FIG. 2, providing a front view of the sign apparatus 10 when a first informational message is presented to view. The message panel 30 is sustained within the opening in the frame 20 by the rotation axles 40, 40'. In this example, the first informational message is "OPEN," for example referring to a trucking weigh station open to receive clients. Limitless other first informational messages are possible within the scope of this invention. The first informational message is printed, painted, engraved, embossed, adhered, or otherwise affixed or presented generally centrally and preferably symmetrically within the outer periphery of the first side of the inner message panel 30, in any of the manners known in the art of highway signage. So, when presented for viewing, the first informational message appears as seen in FIGS. 1 and 2, with the first side of the message panel facing forward. FIGS. 1, 2, and 3 depict the sign apparatus 10 with the message panel in what hereinafter is referred to as the first informational position.

FIG. 3 is a rear view of the apparatus 10, showing the second informational message, in this example "CLOSED," as it would appear to a person looking at the back of the sign apparatus 10 (when the first informational message is presented to view, e.g., to approaching motorists). The second informational message is printed, painted, engraved, embossed, adhered, or otherwise affixed or presented, generally centrally and symmetrically on the second side of the inner message panel 30, within the outer periphery of the message panel.

FIG. 3 also shows the use of the pair of outer panel straps 70 to connect together the upper frame panel 24 and lower frame panel 22 that combine to define the outer frame 20. The signposts 11 also hold the frame panels 22, 24 in proper position relative to one another, in addition to mounting the overall apparatus 10 to the ground. The central axle pins of the axle assemblies 40, 40' preferably are recessed into and within the modest frame panel gap which separates slightly the lower frame panel 22 from the upper frame panel 24. The axle assemblies 40, 40' may be fabricated from suitably sized and modified hinges (such as large piano-type hinges) with hinge's two flanges cut (perpendicular to the pivot axis), and the flanges fixedly secured to the respective frame 20 or message panel 30, as by rivets or the like. (See also FIG. 6.) Such modified hinges mount the message panel 30 within the central opening of the frame 20, but permit the message panel to freely spin or rotate not just up to 360 degrees, but through more than 360 degrees, and repeatedly so.

The inner message panel 30 is releasably held in position for proper viewing by means of pairs of permanent magnets. The magnets preferably are strong magnets, but their particular type/composition may be selected according to the size of the sign, cost considerations, and environmental conditions. Suitable magnets include neodymium iron boron (NdFeB), samarium cobalt (SmCo), alnico, and ceramic or ferrite magnets. The magnets, which may be cubic or oblong in shape, are attached to the outer frame 20 and the inner message panel 30 by conventional means such as screws, bolts, rivets, epoxy adhesive, or the like. A cubic-shaped magnet may be, for example, about 1.5 cm dimension on a side. Each magnet has, by way of preferred example, about 13,200 gauss, or about 20 pounds, pull force.

FIGS. 2 and 3 may be considered together and illustrate a preferred placement arrangement of various magnets. FIG. 2 shows that the front side of the outer frame 20 has, for example, two magnets. Magnet 50 is secured to the frame 20 in the general vicinity of its lower left portion or corner. Magnet 50 preferably is secured to the front side of the lower frame panel 22 very near or adjacent the separation gap which separates the frame panel from the message panel 30. Magnet 50 may hereinafter be referred to as "first magnet." The frame 20 also is provided with magnet 51 in the vicinity of the frame's lower right corner. Magnet 51 preferably is secured to the front side of the lower frame panel 22, also beside or adjacent the separation gap which separates the frame from the message panel 30. Magnet 51 may hereinafter be referred to as "second magnet." FIG. 3 shows that the rear or back side of the frame 20 preferably has three magnets. Magnet 52 is in the vicinity of the frame portion's upper left corner (as viewed in FIG. 3). Magnet 52 preferably is secured to the rear side of the upper frame panel 24 also very near or adjacent the separation gap which separates the frame from the message panel 30. Magnet 52 may hereinafter be referred to as "third magnet." Magnet 53 is in the vicinity of the frame's upper right corner (as viewed in FIG. 3). Magnet 53 is secured to the rear side of the upper frame panel 24, also beside or adjacent the gap which separates the frame from the message panel 30. Magnet 53 may hereinafter be referred to as "fourth magnet." Another magnet, magnet 54, is in the vicinity of the frame's lower center (lateral center, as viewed in FIG. 3). Magnet 54 preferably is secured to the rear side of the lower frame panel 22, also adjacent the separation gap which separates the frame portion from the message panel 30. Magnet 54 may hereinafter be referred to as "fifth magnet."

FIG. 2 illustrates the location of two magnets on the first side of the inner message panel 30. Magnet 60 is in the vicinity of the message panel's upper center (lateral center, as viewed in FIG. 2). Magnet 60 is secured to the first side of the message panel 30 very near or adjacent the separation gap which separates the frame 20 from the message panel. Magnet 60 may hereinafter be referred to as the "sixth magnet." Another magnet, magnet 61, is secured to the front side of the message panel 30 in the vicinity of its lower left corner. Magnet 61 is secured to the first side of the message panel 30 adjacent or beside the separation gap which separates the frame 20 from the message panel 30. Magnet 61 may hereinafter be referred to as the "seventh magnet." As seen in FIG. 2, when the first side of the message panel 30 is facing forward to be viewed, its magnet 61 is closely adjacent the magnet 50 on the frame 20; the strong attraction between the paired magnets 50, 61, helps hold the message panel in the viewing position seen in FIG. 2, with the first informational message in view.

FIG. 3 illustrates the locations of two magnets on the second side of the message panel 30. The second side of the message panel 30 bears the second informational message, in this instance "CLOSED." Magnet 62 is in the vicinity of the message panel's lower center (lateral center, as viewed in FIG. 3). Magnet 62 is secured to the second side of the message panel 30 adjacent the separation gap which separates the frame 20 from the message panel. Magnet 62 may hereinafter be referred to as "eighth magnet." As seen in FIG. 3, when the first side of the message panel 30 is facing forward to be viewed, the magnet 62 (on the second side of the message panel 30) is closely adjacent the magnet 54 on the back side of the frame 20; the strong attraction between the paired magnets 54, 62, helps hold the message panel 30 in the viewing position seen in FIG. 2. Another magnet, magnet 63, is on the second side of the message panel 30 in the vicinity of the message panel's upper left corner (as viewed in FIG. 3). Magnet 63 is secured to the second side of the message panel 30 adjacently near the gap which separates the frame 20 from the message panel. Magnet 63 may hereinafter be referred to as the "ninth magnet."

As seen in FIG. 3, when the first side of the message panel 30 is facing forward to be viewed, the magnet 63 (on the second, non-viewed side of the message panel 30) is closely adjacent the magnet 52 on the rear side of the frame 20. The strong attraction between the paired magnets 52, 63, helps hold the message panel in the viewing position seen in FIG. 2; the frame 20 and the message panel 30 are essentially coplanar, and the first side of the message panel faces forward to present the first informational message to viewers.

When it is desired to present the second informational message to a viewer, the operator reverses the message panel 30 by rotating it on the axles 40, 40' and about its axis of rotation. A significant advantage of the apparatus 10 is that this rotary motion can be easily imparted to the message panel 30 by personnel 80 standing on the ground 85, potentially seven or ten feet below the message panel, as seen in FIG. 7. This can be done by the simple expedient of using a lightweight pole 82 or rod to press firmly on the message panel 30, either above or below its axis of rotation, also as suggested in FIG. 7. Only force sufficient to overcome the attraction between paired magnets on the frame 20 and the message panel 30, respectively, is needed to break the attraction between the magnets and permit the message panel to "flipped" or spun into its second, alternative position.

Figure 4:
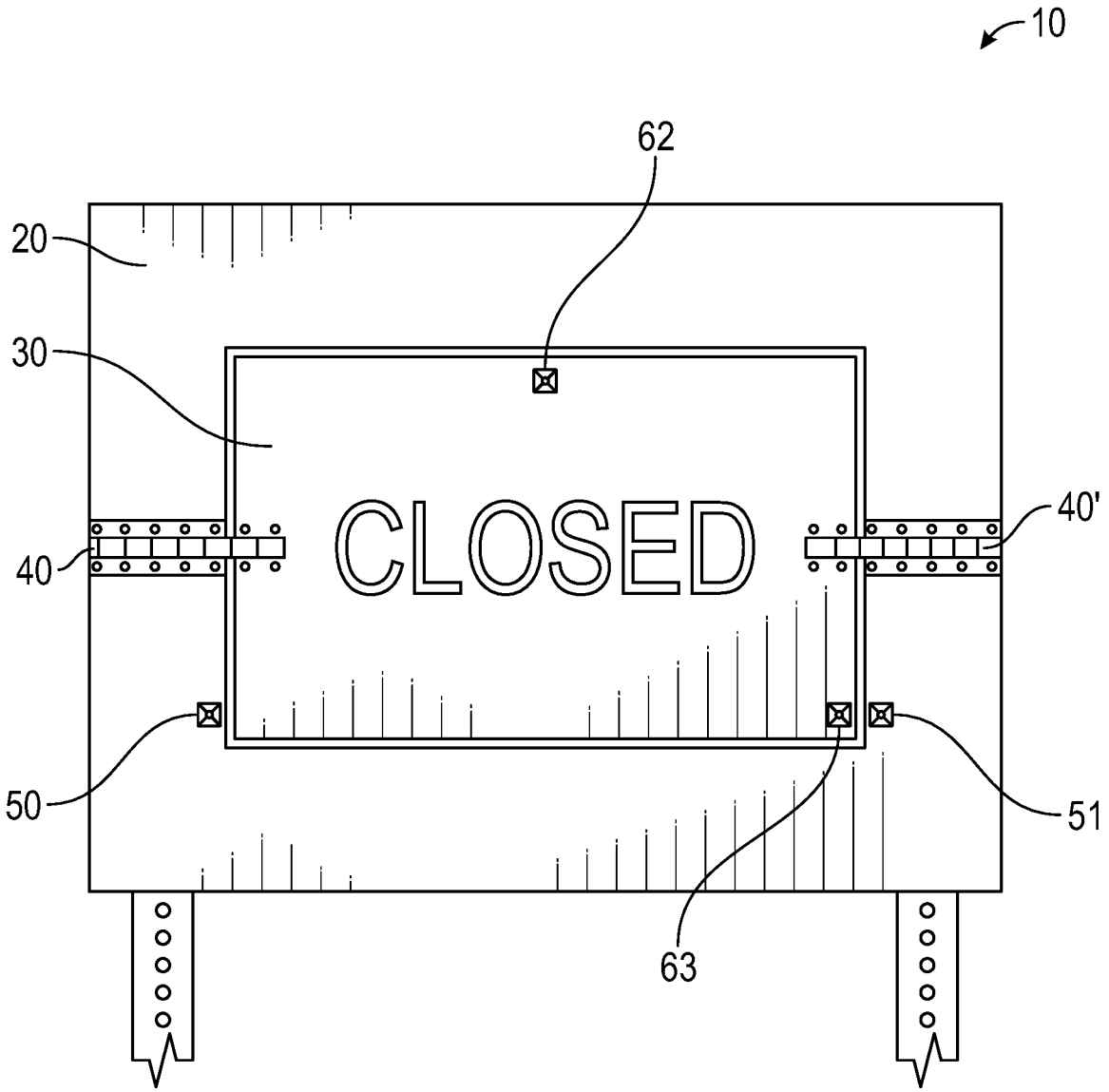
FIG. 4 is an enlarged front view of the apparatus shown in FIG. 1, but with the inner message panel having been rotatably reversed to a second informational position to present the second message for viewing.
Figure 5:
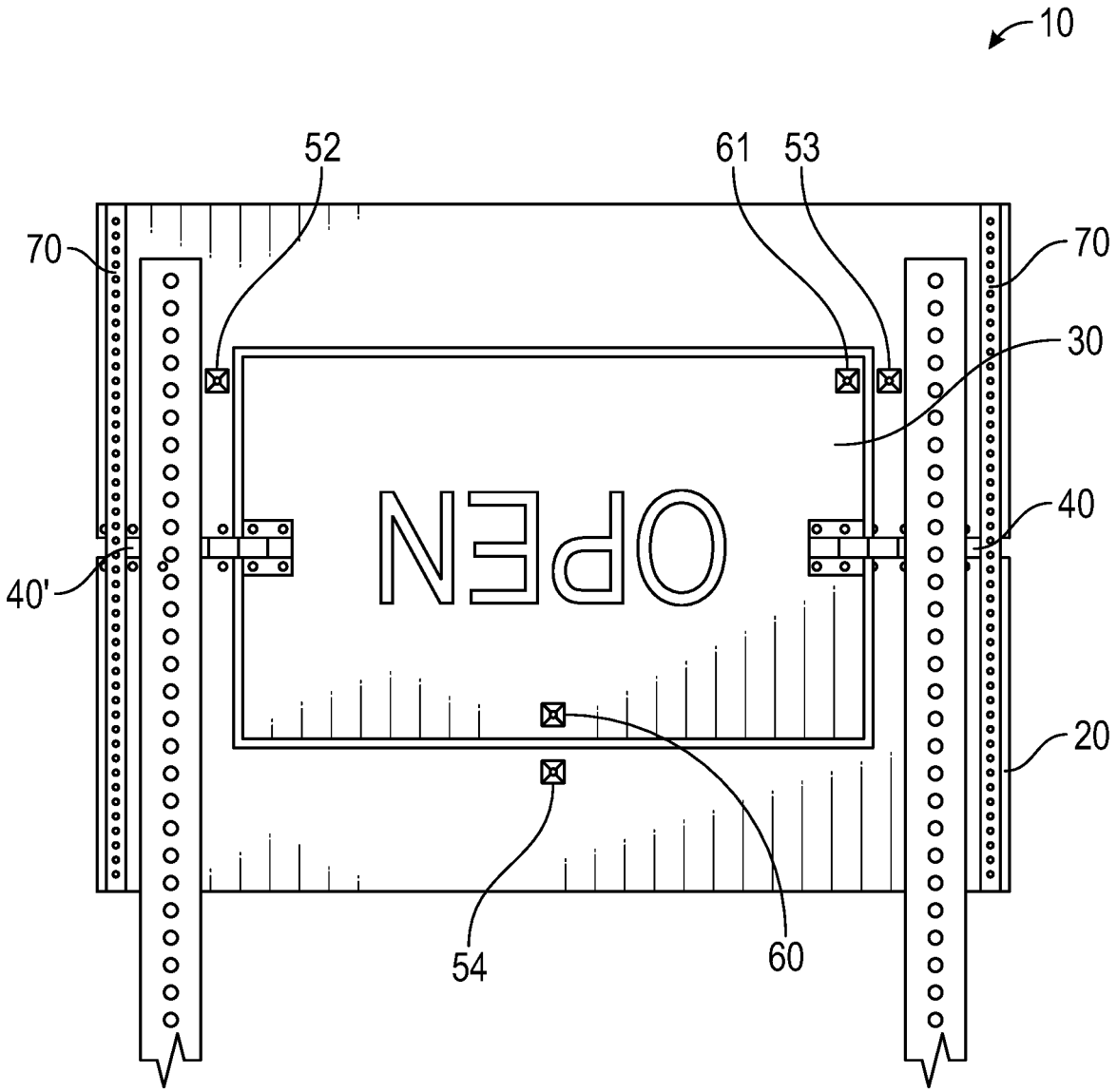
FIG. 5 is an enlarged rear view of the apparatus shown in FIG. 4, depicting the first message that now is not presented for immediate viewing.

FIGS. 4 and 5 are intended to be considered together, and illustrate the configuration and appearance of the sign apparatus 10 when the message panel 30 has been rotated to present the second informational message to a viewer, and a preferred location of various magnets when the sign apparatus is so configured. FIGS. 4 and 5 show the sign 10 in its "second informational position." In FIG. 4, the second side of the message panel 30 is facing forward, to be seen by viewers such as oncoming motorists. The second informational message, e.g., "CLOSED," is easily seen, while the first information message ("OPEN") is now generally unseen because it is now registered with the rear or back side of the outer frame 20, as seen in FIG. 5. In the configuration of FIG. 4, the magnet 63 on the second side of the message panel 30 has, by the rotation of the message panel 30, been brought into close adjacency to the magnet 51 on the outer frame 20. Because the magnets 51, 63 are in paired close confronting relation, their mutual attraction helps maintain the message panel in the proper position of FIG. 4—that is, with the second informational message facing forward.

When the second informational message is presented for viewing, the first side of the message panel 30 is registered with the back side of the frame 20, as seen in FIG. 5. It also is seen that when the message panel 30 is rotated to this position, its magnet 61 (on the first side of the message panel) is brought into close adjacency with the magnet 53 on the rear side of the outer frame 20. Similarly, the magnet 60 on the first side of the message panel 30 is now aligned adjacent to the magnet 54 on the rear side of the outer frame 20. The magnetic attraction between magnets pair 53, 61, and the magnetic attraction between magnets pair 54, 60, hold the message panel 30 in proper position to present for viewing the second informational message, as seen in FIG. 4.

It is observed that when the first side of the message panel 30 is facing forward to present the first informational message for viewing (i.e., the first informational position per FIGS. 2 and 3), there are three pairs of magnets releasably holding the message panel 30 in proper position for observation. These pairs are: the magnet pair 50, 61 on the front side of the frame portion and the first side of the message panel, respectively; and two magnet pairs, pair 52, 63 and pair 54, 62 on the rear side of the frame portion and the second side of the message panel, respectively. And combined reference to FIGS. 4 and 5 discloses that when the second side of the message panel 30 is facing forward to present the second informational message for viewing (i.e., the second informational position), there are also are three different, separate, pairs of magnets releasably holding the message panel 30 in proper position for observation. These pairs are: the magnet pair 51, 63 on the front side of the frame 20 and the second side of the message panel 30, respectively, and two magnet pairs, pair 54, 60 and pair 53, 61 on the rear side of the frame and the first side of the message panel, respectively.

Attention is returned to FIGS. 2 and 3. The message panel 30 is in the first informational position seen in those figures. In the first informational position, the first magnet 50 is beside the seventh magnet 61, and this pair of magnets mutually releasably attract one another. When the panel 30 is in the first informational position, the third magnet 52 is beside the ninth magnet 63, and the fifth magnet 54 is beside the eighth magnet 62, so that these respective two pairs of magnets mutually releasably attract one another. As explained hereinabove, the message panel 30 is controllably movable from the first informational position of FIGS. 2 and 3 to the second informational position seen in FIGS. 4 and 5. In the second informational position, the second magnet 51 is beside the ninth magnet 63, and this pair of magnets mutually releasably attract one another. Also, when the panel 30 is in the second informational position, the fourth magnet 53 is beside the seventh magnet 61, and the fifth magnet 54 is beside the sixth magnet 60, so that these respective two pairs of magnets mutually releasably attract one another. In the preferred embodiment of the sign apparatus 10, accordingly, selected ones of the magnets are used to releasably hold the message panel 30 in position, without regard for whether it is in the first or the second informational position, thereby reducing the total number of relatively expensive magnets employed in the apparatus.

And thus is it seen that regardless whether the first informational message or the second informational message is presented facing forward for viewing, three pairs of magnets are in adjacency to maintain the message panel 30 in proper position—regardless whether the message panel 30 is in the first informational position or the second informational position. The apparatus 10 accordingly is configured to provide, with a relatively minimal number of magnets, a secure yet dis-engageable maintenance of the message panel 30 in the selected desired presentational position. When the frame 20 and the message panel 30 are in coplanar registration to present the first informational message to viewers, three pairs of magnets, (50, 61), (54, 62), and (52, 63), hold it in position until an operator desires otherwise. Similarly, when the frame 20 and the message panel 30 are in coplanar registration to present the second informational message to viewers, three pairs of magnets, (51, 63), (54, 60), and (53, 61), hold it in position till an operator desires otherwise. So, the message panel 30 can be temporarily maintained in proper position with either its first side or its second side facing forward, but advantageously using only nine magnets in total.

Figure 6:
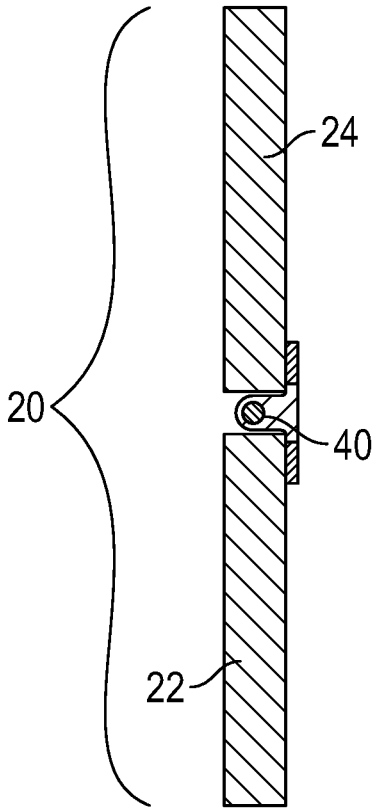
FIG. 6 is a side sectional view of the outer frame portion and an axle assembly of the sign apparatus, taken along section line 6-6 in FIG. 2.

FIG. 6 illustrates that each axle assembly 40, 40'—one left side axle assembly 40 depicted in FIG. 6—preferably is disposed in the horizontal frame panel gap in the frame 20, between the lower frame panel 22 and the upper frame panel 24, so to promote a coplanar positional relationship between the frame and the message panel 30 when those two elements are in registration for message presentation. (The axle pins may likewise be recessed or set into a colinear groove or channel defined in the message board 30.) Each axle assembly 40 and 40' has an axle pin that spans the vertical separation gap between the message panel 30 and the frame 20 to maintain their translational positions relative to each other; the message panel cannot move relative to the frame 20 except in rotary motion. The respective sides of each axle assembly 40, 40', on either side of the separation gap between frame and message panels (20, 30), are securely affixed to a corresponding surface of the frame 20 or a surface of the message panel 30, as by driving rivets or screws through an axle flange into the surface of the flush adjacent surface of the respective element, i.e., panel 30 or frame 20. Heavy-duty "piano" type hinges can be modified to fabricate suitable axle assemblies. Useful combined reference also can be had to FIGS. 2 and 4, showing the configurations of the axle assemblies 40, 40' when the message panel 30 is in either of its two informational positions.

Despite the magnet pairs reliably holding the message panel 30 in a selected presentational position, it nevertheless is easy to "flip" the message panel to reverse its vertical orientation through 180 degrees to place the other side of the message board in presentation position for viewers. The sign 10 thus is readily reversible, in which the message panel 30 is easily movable back and forth between its first information position and its second informational position. Again, this is readily done without the need to disengage any latches, clips, or hasps, manually either with or without tools.

The operator need not be proximally close to the reversible sign 10 to lay hands on it to change the message presented for viewing. The change can be accomplished by simply pushing on the upper and/or lower portion of the message panel 30, as with a stick or rod, to easily overcome the magnetic attraction between the various pairs of magnets; the message panel is then readily rotated through 180 degrees to place the alternative (first or second) side of the message panel 30 in viewing presentation at the front of the sign 10. This manipulation and controlled rotation of the message panel 30 can be accomplished without using any tools, except that if the sign is high (e.g., seven to ten feet) above the operator 80, the simple tool of a short lightweight pole 82 can be employed to switch the message panel 30 between the two positions, as indicated in FIG. 7.

If desired, two operators can accomplish the reversing switch-over; one operator can apply pressure to the upper portion of one side of the message panel 30 while a second operator may simultaneously apply pressure to the lower portion of the opposite side of the message panel 30, thereby to rotate the message panel to the desired position. With coordinated effort, two operators can change a sign 10 back and forth between the two possible presentations; two operators are particularly indicated for relatively larger signs, or in the event of the switch-over taking place in high winds. The magnets are selected, however, with attractive strength suited to the size of the sign apparatus. Magnet strengths are selected which permit attractive forces to be readily overcome by users, yet which prevent the message panel 30 from being rotated by, for example, a gust of wind. Once the message panel 30 has been rotated to place the desired side and message forward for viewing, the attraction between those pairs of magnets that have been placed besides one another thereafter hold the message panel in position until a user(s) deliberately rotate it to bring the other, opposite, side/message into view.

While this disclosure has taught the use of a two-sided message panel 30, a person of ordinary skill in the art will appreciate that the message panel 30 could be fabricated to have three message sides, i.e., the panel 30 having a triangular cross-section. Such an alternative embodiment would permit the message panel to be selectively rotated through 120 degrees to permit any one of three message sides to be brought into coplanar registration with the front side of the outer frame 20.

Although the invention has been described in detail with particular reference to the preferred embodiments, other embodiments can achieve the same results. While the invention has been described in relation to a preferred embodiment thereof shown in the accompanying drawings, it also is to be recognized that the same is readily susceptible to modification, variation and substitution of equivalents without avoiding the invention. The system and apparatus are not intended to be limited by the foregoing, and it is intended to cover in the appended claims all such modifications and equivalents.

What is claimed is:

1. A reversible sign apparatus comprising:

an outer frame having a central opening therethrough;

a message panel, rotatably disposed in the opening, and comprising a first side and a second side;

at least two axle assemblies for rotatably mounting the message panel in the outer frame; and magnets, disposed on the outer frame and on the message panel, mutually attractive to releasably hold the message panel in either of a first informational position or a second informational position;

wherein the message panel is repeatedly rotatable between the first informational position and the second informational position, and between the second informational position and the first informational position;

wherein when the message panel is in the first informational position, the magnets releasably hold the message panel in the first informational position; and wherein when the message panel is in the second informational position, the magnets releasably hold the message panel in the second informational position.

2. The apparatus according to claim 1 wherein:

the outer frame comprises an upper frame panel separated from a lower frame panel by a frame panel gap;

each of the axle assemblies comprises flanges and a pin, the axel pin situated within the frame panel gap; and at least one of the flanges is fixed to the outer frame and at least one other of the flanges is fixed to the message panel.

3. The apparatus according to claim 2 wherein the axle assemblies comprise modified piano hinges.

4. The apparatus according to claim 1 wherein the message panel is symmetrical and rotatable through 180 degrees about a horizontal axis of rotation.

5. The apparatus according to claim 1 wherein a separation gap is defined between the frame and the message panel, and the magnets are secured adjacent the separation gap.

6. The apparatus according to claim 5 wherein the magnets comprise at least nine magnets.

7. The apparatus according to claim 6 wherein:

when the message panel is arranged in the first informational position, three pairs of magnets releasably hold the message panel in position; and when the message panel is in the second informational position, three different pairs of magnets releasably hold the message panel in position.

8. The apparatus according to claim 7 wherein:

when the message panel is in the first informational position, a first magnet is beside a seventh magnet, which first and seventh magnets mutually releasably attract one another;

when the panel is in the first informational position, a third magnet is beside a ninth magnet, which third and ninth magnets mutually releasably attract one another; and when the panel is in the first informational position, a fifth magnet is beside an eighth magnet, which fifth and eighth magnets mutually releasably attract one another.

9. The apparatus according to claim 8 wherein:

after the message panel is moved to the second informational position, a second magnet is beside the ninth magnet, which second and ninth magnets mutually releasably attract one another;

when the message panel is in the second informational position, a fourth magnet is beside the seventh magnet, which fourth and seventh magnets mutually releasably attract one another; and when the message panel is in the second informational position, the fifth magnet is beside a sixth magnet, which fifth and sixth magnets mutually releasably attract one another.

10. A reversible sign apparatus comprising:

an outer frame, comprising an upper frame panel separated from a lower frame panel by a frame panel gap, and having a central opening therethrough;

a message panel, rotatably disposed in the opening, and comprising a first side and a second side;

at least two axle assemblies for rotatably mounting the message panel in the outer frame, each of the axle assemblies comprising flanges and a pin, the axel pin situated within the frame panel gap; and magnets, disposed on the outer frame and on the message panel, mutually attractive to releasably hold the message panel in either of a first informational position or a second informational position;

wherein at least one of the flanges is fixed to the outer frame and at least one other of the flanges is fixed to the message panel; and wherein the message panel is repeatedly rotatable between the first informational position and the second informational position, and between the second informational position and the first informational position.

11. The apparatus according to claim 10 wherein the axle assemblies comprise modified piano hinges.

12. The apparatus according to claim 10 wherein at least one of the magnets has approximately 13,200 gauss attraction force.

13. The apparatus according to claim 10 wherein at least one of the magnets has approximately 20 pounds attraction force.

14. The apparatus according to claim 10 wherein the magnets comprise at least nine magnets.

15. The apparatus according to claim 14 wherein:

when the message panel is arranged in the first informational position, three pairs of magnets releasably hold the message panel in position; and when the message panel is in the second informational position, three different pairs of magnets releasably hold the message panel in position.

16. The apparatus according to claim 15 wherein:

when the message panel is in the first informational position, a first magnet is beside a seventh magnet, which first and seventh magnets mutually releasably attract one another;

when the panel is in the first informational position, a third magnet is beside a ninth magnet, which third and ninth magnets mutually releasably attract one another; and when the panel is in the first informational position, a fifth magnet is beside an eighth magnet, which fifth and eighth magnets mutually releasably attract one another.

17. The apparatus according to claim 16 wherein:

after the message panel is moved to the second informational position, a second magnet is beside the ninth magnet, which second and ninth magnets mutually releasably attract one another;

when the message panel is in the second informational position, a fourth magnet is beside the seventh magnet, which fourth and seventh magnets mutually releasably attract one another; and when the message panel is in the second informational position, the fifth magnet is beside a sixth magnet, which fifth and sixth magnets mutually releasably attract one another.

18. A reversible sign apparatus comprising:

an outer frame having a central opening therethrough;

a message panel, rotatably disposed in the opening, and comprising a first side and a second side;

at least two axle assemblies for rotatably mounting the message panel in the outer frame;

at least nine magnets, disposed on the outer frame and on the message panel, mutually attractive to releasably hold the message panel in either of a first informational position or a second informational position; and a separation gap defined between the outer frame and the message panel, wherein the magnets are secured adjacent the separation gap;

wherein the message panel is repeatedly rotatable between the first informational position and the second informational position, and between the second informational position and the first informational position; and wherein when the message panel is arranged in the first informational position, three pairs of magnets releasably hold the message panel in position, and when the message panel is in the second informational position, three different pairs of magnets releasably hold the message panel in position.

19. The apparatus according to claim 18 wherein:

the outer frame comprises an upper frame panel separated from a lower frame panel by a frame panel gap;

each of the axle assemblies comprises flanges and a pin, the axel pin situated within the frame panel gap; and at least one of the flanges is fixed to the outer frame and at least one other of the flanges is fixed to the message panel.

20. The apparatus according to claim 18 wherein the axle assemblies comprise modified piano hinges.

* * * * *